US008286601B2

(12) United States Patent
Hamaoka et al.

(10) Patent No.: US 8,286,601 B2
(45) Date of Patent: Oct. 16, 2012

(54) VARIABLE VALVE TIMING APPARATUS

(75) Inventors: Yasuhiro Hamaoka, Kariya (JP); Akihiko Takenaka, Anjo (JP); Takashi Yamaguchi, Obu (JP)

(73) Assignee: Denso Corporation, Kariya (JP)

( * ) Notice: Subject to any disclaimer, the term of this patent is extended or adjusted under 35 U.S.C. 154(b) by 364 days.

(21) Appl. No.: 12/705,144

(22) Filed: Feb. 12, 2010

(65) Prior Publication Data

US 2010/0199938 A1 Aug. 12, 2010

(30) Foreign Application Priority Data

Feb. 12, 2009 (JP) ..... 2009-30012

(51) Int. Cl.
*F01L 1/34* (2006.01)

(52) U.S. Cl. ..... 123/90.17; 123/90.15; 464/160

(58) Field of Classification Search ..... 123/90.15, 123/90.17; 464/160
See application file for complete search history.

(56) References Cited

U.S. PATENT DOCUMENTS 4,858,572 A * 8/1989 Shirai et al. ..... 123/90.12
6,378,476 B2 4/2002 Okada et al.
6,378,477 B1 4/2002 Fukuhara et al.
6,439,184 B1 8/2002 Takenaka et al.
6,779,499 B2 8/2004 Takenaka et al.
7,234,427 B2 6/2007 Lehmann et al.

FOREIGN PATENT DOCUMENTS

JP 11-270317 10/1999

OTHER PUBLICATIONS

Japanese Office Action dated Jan. 6, 2011, issued in corresponding Japanese Application No. 2009-030012 with English Translation.

* cited by examiner

*Primary Examiner* — Ching Chang
(74) *Attorney, Agent, or Firm* — Nixon & Vanderhye PC

(57) ABSTRACT

A variable valve timing apparatus includes a stopper piston which has an equalizing passage in an axial direction. Even if the engaging hole is filled with the oil, the equalizing passage enables the oil flows from an engaging hole to a holding hole when the stopper piston enters into the engaging hole. It is possible to form a vane as narrow as possible, and to enlarge a variable angular range. In addition, the stopper piston has both end faces which are substantially identical in surface area. Even if pulsation arises in oil pressure, pressures acting on both end faces of the stopper piston can be substantially cancelled and position of the stopper piston can be stabilized.

8 Claims, 5 Drawing Sheets

VARIABLE VALVE TIMING APPARATUS

CROSS REFERENCE TO RELATED APPLICATION

This application is based on Japanese Patent Application No. 2009-30012 filed on Feb. 12, 2009, the contents of which are incorporated herein by reference in its entirety.

FIELD OF THE INVENTION

The present invention relates to a variable valve timing apparatus which varies timing of opening and/or closing of at least one of an intake valve and an exhaust valve of an internal combustion engine.

BACKGROUND OF THE INVENTION

A patent document 1, U.S. Pat. No. 6,779,499 (JP 2002-357105A) discloses a vane type variable valve timing apparatus. The variable valve timing apparatus may be referred to as a VVT. The VVT is installed in a drive train between a crankshaft of an internal combustion engine and a cam shaft which opens and closes a valve. The vane type VVT has a housing engaged with the crankshaft and a vane rotor engaged with the cam shaft. The housing and the vane rotor define an advance chamber and a retard chamber therebetween. The chambers are supplied with operating fluid, such as oil. The advance chamber is enlarged by being supplied with the oil when advancing valve timing. The retard chamber is enlarged by being supplied with the oil when retarding valve timing.

The vane type VVT may include a stopper member which locks the housing and the vane rotor at a predetermined relative position, such as a middle position or a most retard position. The stopper member may be located on the vane rotor. The stopper member locks the housing and the vane rotor by engaging itself into an engaging hole formed on the housing. For example, the stopper member may lock the housing and the vane rotor when the engine is in a starting, i.e. in a cranking stage or a slow rotational speed stage. The stopper member contributes to provide a secure and stable transmission of driving force from the crankshaft to the cam shaft, and to prevent noise caused by the housing and the vane rotor hit each other by relative rotational vibrations.

SUMMARY OF THE INVENTION

In the conventional configuration of the stopper member, the engine may be stopped by an unexpected stall at a condition in which the stopper member is not engaged with the engaging hole. In this case, at restarting the engine in the next drive, it is necessary to lock the housing and the vane rotor by engaging the stopper member with the engaging hole by rotating the vane rotor by using fluctuation torque on the cam shaft.

In the conventional VVT, the engaging hole is filled with the oil, therefore, the stopper member must squeeze the oil in the engaging hole back into an oil passage when engaging the stopper member. However, the structure of the stopper member disclosed in the patent document 1 has a problem that a response speed of the stopper member is lowered because the pressure loss for squeezing the oil by a distal end part of the stopper member is increased.

In order to solve this problem, the housing may be provided with a relief passage which is communicated with the engaging hole and enables discharge the oil to an outside. If there is such a passage, when the stopper member enters the engaging hole, the oil filled in the engaging hole is discharged to the outside via the passage, therefore, the oil does not impede the stopper member.

However, in order to control leakage of the oil through the relief passage, it is necessary to install a shut down valve which shuts down the communication path between the chamber and the relief passage in a regular operating stage. For example, if such a shut down valve is provided by an axial end surface of the vane rotor which slides on a side wall of the housing on which the engaging hole is formed, the vane rotor must be formed wide in a circumferential direction to seal the engaging hole in a regular operating stage. However, it is difficult to widen the vane rotor because such a wide vane may reduce variable angular range as the VVT. Therefore, it is difficult to suffice both requirements for response speed of the stopper member and variable angular range.

In another aspect, the stopper member usually receives pressure of the oil supplied to the VVT. The pressure usually contains pulsations caused by small rotational movement of the vane rotor. Therefore, the conventional structure of the stopper member may be moved in response to the pressure pulsation, and may be moved adversely. As a result, it is concerned that the housing and the vane rotor are locked or unlocked at an unexpected timing.

It is an object of the present invention to provide an improved VVT in which it is reduced to impede movement of the stopper member by the fluid.

It is another object of the present invention to provide an improved VVT in which it is reduced to impede movement of the stopper member by the fluid and in which a sufficient variable angular range is obtained.

It is still another object of the present invention to provide an improved VVT in which it is reduced to impede movement of the stopper member by the fluid and in which the stopper member is stable against pulsations of the fluid.

It is still another object of the present invention to provide an improved VVT which has a wide variable angular range and stable characteristics which is not influenced by pulsations of the fluid.

According to an aspect of the present invention, a variable valve timing apparatus is installed in a drive train for transmitting driving force from a drive shaft to a driven shaft which actuates at least one of an intake valve and an exhaust valve. The variable valve timing apparatus is installed to adjust valve timing. The apparatus comprises a housing having a peripheral wall, and side walls placed on both axial ends of the peripheral wall to define a chamber. The he housing is rotatable with one of the drive shaft and the driven shaft. The apparatus further comprises a vane rotor disposed in the chamber, the vane being rotatable with the other one of the drive shaft and the driven shaft within a predetermined angular range in response to a pressure of fluid supplied in a pressure chamber in the chamber. The apparatus further comprises a restricting member for restricting relative rotation of the vane rotor with respect to the housing. One of the vane rotor and the housing define a holding hole which holds the restricting member in a manner that the restricting member is movable. The other one of the vane rotor and the housing define an engaging hole which is able to be engaged with an end of the restricting member, and wherein the restricting member being formed in a hollow cylindrical shape which defines an equalizing passage capable of communicating the engaging hole and the holding hole to flow the fluid when the restricting member enters into the engaging hole.

In another aspect of the present invention, the restricting member defines both ends having substantially identical area.

As a result, pulsations on the oil pressure equally act on the first part 85 and the second part 86 and are cancelled each other.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

Hereinafter, embodiments of the present invention are described in detail referring to the attached drawings. In the following description and drawings, the same reference numbers and symbols are given to components and parts which are the same or similar to that already described in the preceding embodiments. The preceding description may be referenced for the components and parts denoted by the same reference numbers and symbols. Hereinafter, differences from the preceding embodiments are mainly explained in the following embodiments. Other configurations are similar to or the same as that of the preceding embodiments, therefore, unless it is apparent, it is possible to achieve similar or the same functions and advantages as described in the preceding embodiments.

First Embodiment

FIGS. 1-4 show a variable valve timing apparatus according to the first embodiment of the present invention. The variable valve timing apparatus is referred to as a VVT. The VVT 10 is installed in a drive train for an intake valve of an internal combustion engine. The VVT 10 is a fluid control type which uses oil as operational fluid.

Figure 2:
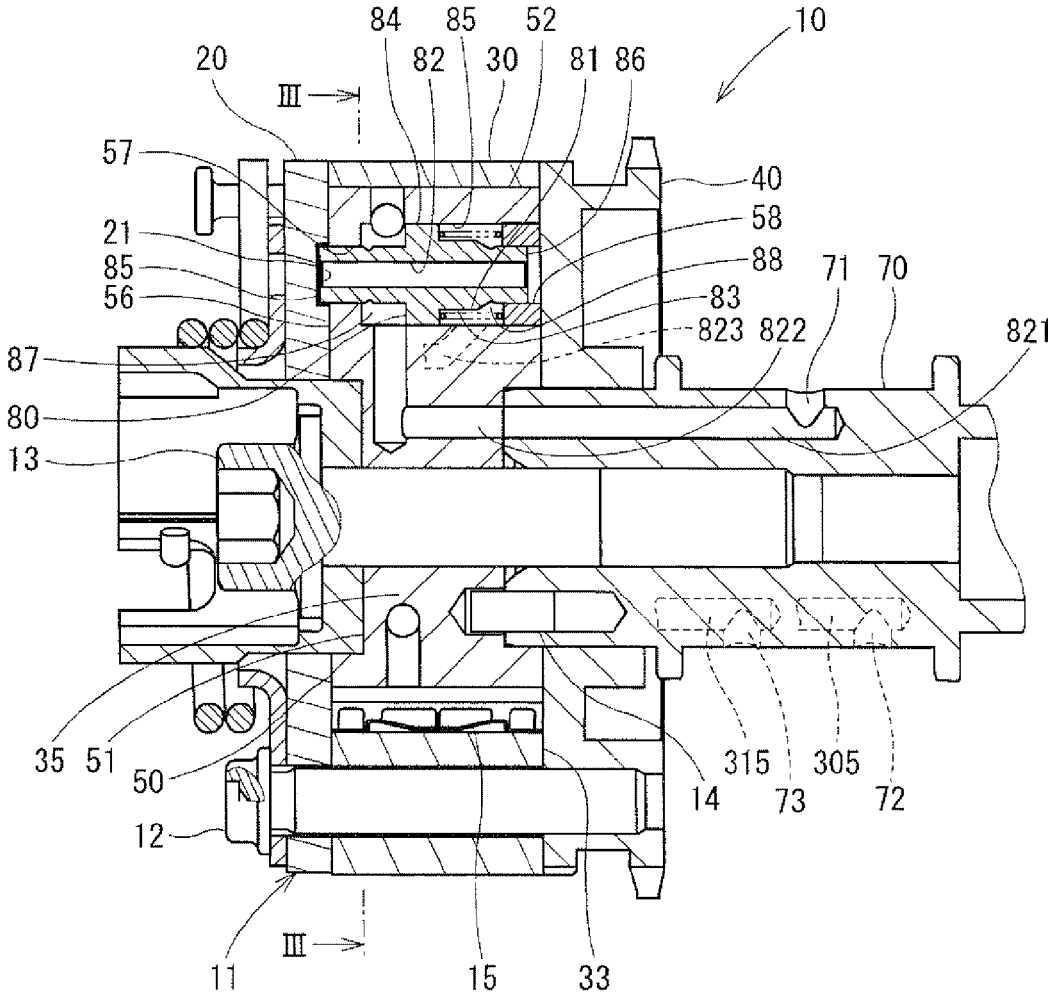
FIG. 2 is a sectional view showing the VVT according to the first embodiment of the present invention.

As shown in FIG. 2, the VVT 10 is provided with components including a housing 11 and a vane rotor 50. The housing 11 has a front plate 20 as a side wall on one end, a shoe housing 30 as a peripheral wall, and a chain sprocket 40 as a side wall on the other end. The front plate 20, the shoe housing 30, and the chain sprocket 40 are being fixed with bolts 12 in a coaxial manner. Thereby, the front plate 20 and the chain sprocket 40 are fixed on respective axial ends of the shoe housing 30. The shoe housing 30, the front plate 20, and the chain sprocket 40 define a chamber 35 therein. The chamber 35 includes a center part and three fan-shaped parts. The fan-shaped parts are called as vane chambers 351. The chain sprocket 40 is engaged with a chain, not illustrated, which is engaged with a crankshaft of the engine, also not illustrated, and receives rotational driving force. The chain sprocket 40 rotates with the crankshaft in a synchronizing manner. The shoe housing 30, the front plate 20, and the chain sprocket 40 provides the housing 11 or a casing in a broad definition.

The driving force of the crankshaft is transmitted to the cam shaft 70 which is provided as a driven shaft via the housing 11. The crankshaft is a driving shaft. The cam shaft 70 actuates the intake valve, not illustrated, to open and close an intake port. The cam shaft 70 is inserted in the chain sprocket 40 in a relatively rotatable manner. As explained later, the cam shaft 70 is relatively rotatable with respect to the chain sprocket 40 in a predetermined angular range, i.e., in a predetermined phase difference.

The vane rotor 50 is disposed and housed in the chamber 35. The vane rotor 50 comes in contact with an axial end of the cam shaft 70. The cam shaft 70 and the vane rotor 50 are fixed by the bolt 13 in a coaxial manner. The vane rotor 50 and the cam shaft 70 are engaged at a predetermined position in a rotational direction by engaging a positioning pin 14 to both the vane rotor 50 and the cam shaft 70. The vane rotor 50 and the cam shaft 70 are relatively rotatable with respect to the housing 11. The cam shaft 70, the housing 11, and the vane rotor 50 are regularly rotated in the clockwise direction in a view from the left side of FIG. 2, i.e., in a view from an opposite side to the cam shaft 70. Hereinafter, the regular rotating direction is called as an advance direction of the cam shaft 70 with respect to the crankshaft. In the drawings the advance direction is shown by a symbol "+" and a retard direction is shown by a symbol "−".

Figure 3:
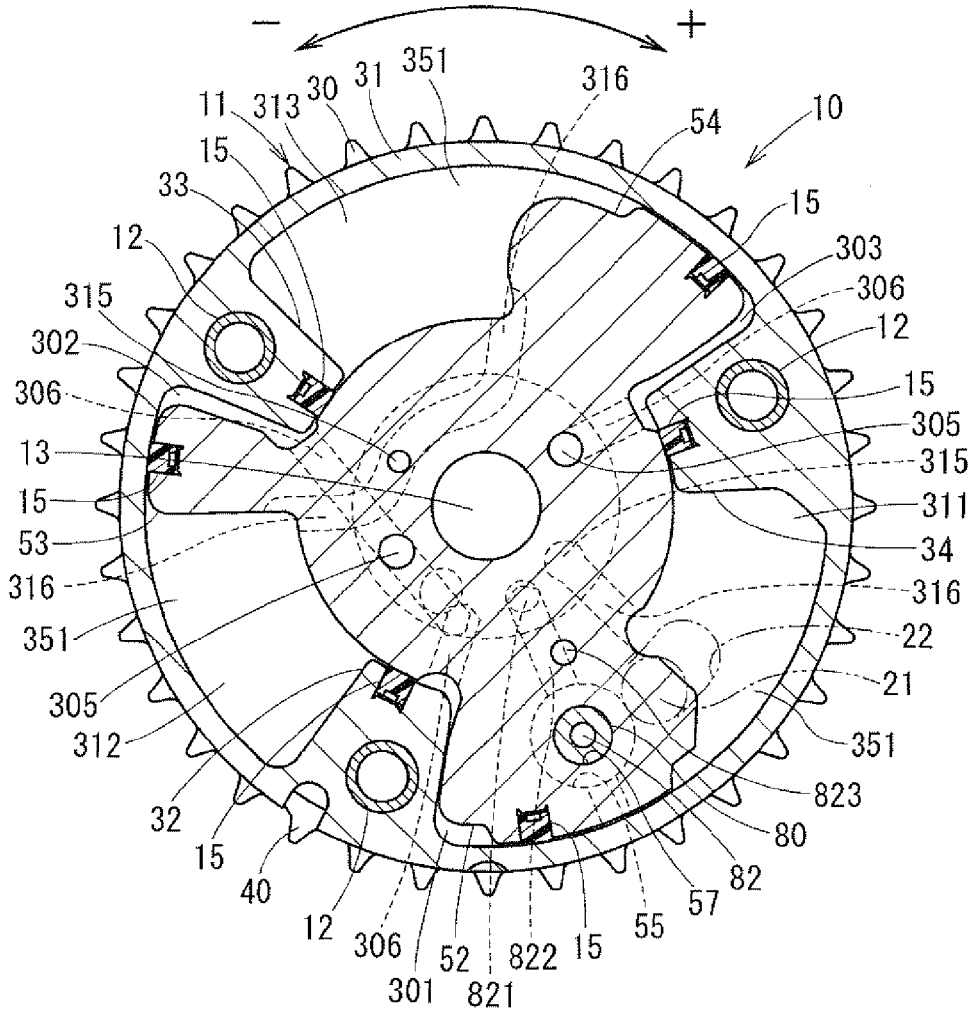
FIG. 3 is a sectional view along a III-III line in FIG. 2, showing the VVT in which the vane rotor is located in the most advanced position.
Figure 4:
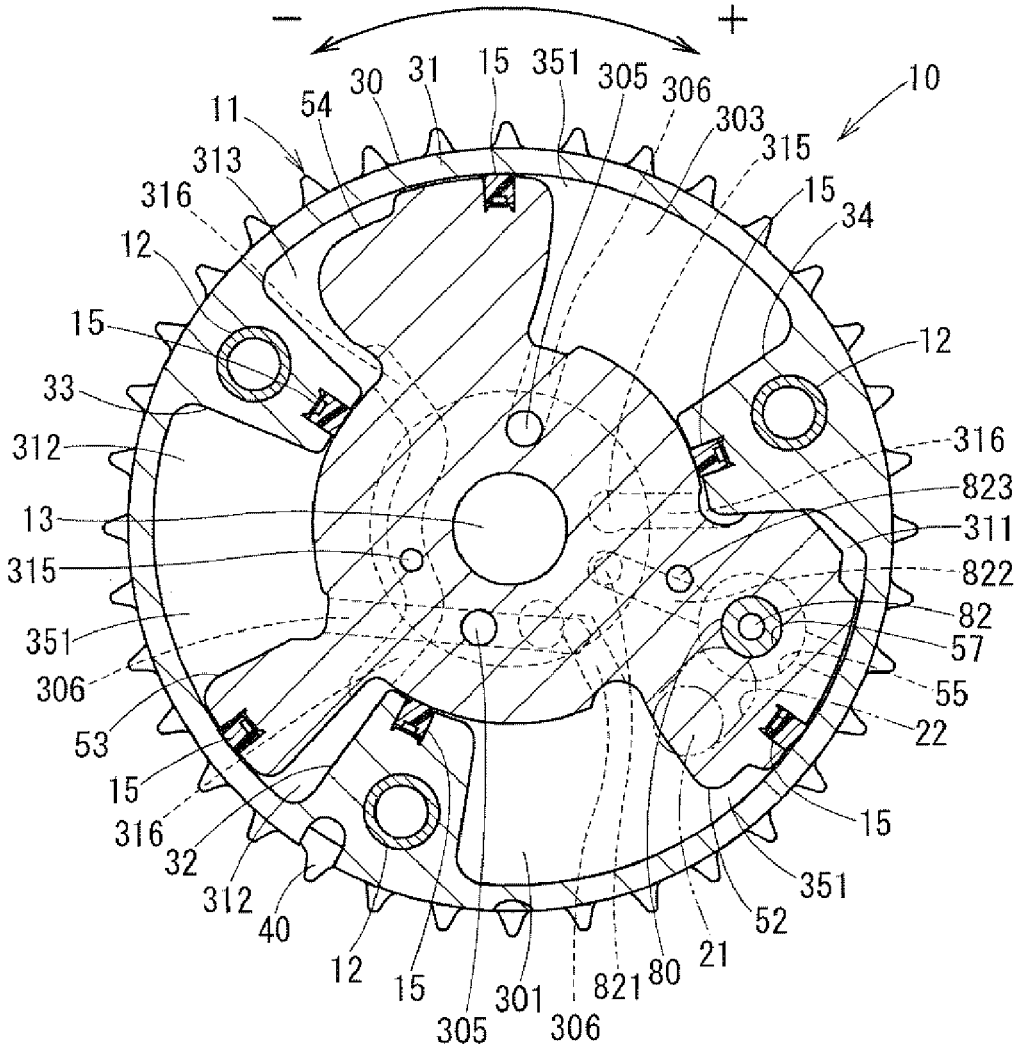
FIG. 4 is a sectional view along a III-III line in FIG. 2, showing the VVT in which the vane rotor is located in the most retarded position.

As shown in FIG. 3 and FIG. 4, the shoe housing 30 has a cylindrical portion 31 formed in a cylindrical shape and shoes 32, 33, and 34 which are prolonged inwardly from the inside of the cylindrical portion 31. The shoes 32, 33, and 34 are formed in approximately trapezoidal shape, and are arranged mostly at equal intervals along a circumferential direction of the cylindrical portion 31.

The vane rotor 50 has a boss portion 51 as a vane support portion, and vanes 52, 53 and 54 as vane member. The boss portion 51 is formed in a columnar shape. The vanes 52, 53 and 54 are arranged on the boss portion 51 in an outwardly protruding manner and are arranged at mostly equal intervals in a circumferential direction. The vanes 52, 53 and 54 are integrally formed in the boss portion 51. The vane rotor 50 is housed and disposed in the chamber 35 in a relatively rotatable manner with respect to the housing 11. The boss portion 51 is disposed in a center part of the chamber 35. Each one of the vanes 52, 53 and 54 is disposed in respective one of the vane chambers 351. The vane chambers 351 are defined between adjacent pair or the shoes 32, 33 and 34 in the chamber 35. As a result, each vane is held in the vane chamber 351 in a rotatable manner within an angular range defined by an angular width of the vane and an angular width of the vane chamber.

Each of the vanes 52, 53 and 54 divides each of the vane chambers 351 into an advance chamber and a retard chamber which are provided as pressure chambers. That is, a retard chamber 301 is formed between the shoe 32 and the vane 52, a retard chamber 302 is formed between the shoe 33 and the vane 53, and a retard chamber 303 is formed between the shoe 34 and the vane 54. An advance chamber 311 is formed between the shoe 34 and the vane 52, an advance chamber 312 is formed between the shoe 32 and the vane 53, and an advance chamber 313 is formed between the shoe 33 and the vane 54.

A plurality of seal members 15 are provided in gaps formed between opposing components in radial directions, such as gaps between the shoes 32, 33, and 34 and the boss portion 51, and gaps between the vanes 52, 53, and 54 and the cylindrical portion 31 of the shoe housing 30.

The shoes 32, 33 and 34 provide axially extending slots formed on radial inside end faces. The canes 52, 53 and 54 provide axially extending slots formed on radial outside end faces. The seal members 15 are inserted in the slots, respectively. The seal members 15 are pushed onto an outer wall of the boss portion 51 or an inner wall of the cylindrical portion 31 by spring members, for example. The seal members 15 provide sufficient seal for the retard chambers and the advance chambers while enabling smooth rotation of the vane rotor 50. The seal members 15 prevent leaking of the oil between the retard chambers and the advance chambers.

As shown in FIG. 2, the vane rotor 50 has a holding hole 55 which penetrates the vane 52 in parallel to an axial direction of rotation. The holding hole 55 houses and holds a stopper piston 80. The holding hole 55 support the stopper piston 80 in a movable manner in an axial direction of the stopper piston 80, i.e., in an axial direction of rotation of the VVT. The holding hole 55 houses the stopper piston in a manner that at least a part of the stopper piston 80 can be protruded from the end of the holding hole 55. The holding hole 55 further houses and holds a spring 81 which is located as a positioning member for the stopper piston 80. The spring 81 is one of a elastic member. In this embodiment, the spring 81 is a coil spring. A part of the vane rotor 50 where the holding hole 55 is formed provides an end face 56 which faces the front plate 20. The end face 56 is an end face of the vane 52 on a side facing the front plate 20. The end face 56 comes in contact with the front plate 20 in a fluid tight manner and in a slidable manner. An inner surface of the vane 52 defining the holding hole 55 includes a large bore part and a small bore part. The large bore part is much longer than the small bore part. The small bore part is formed on a side close to the front plate 20. The small bore part provides a first bearing portion 57 for supporting the stopper piston 80 in a slidable manner. The first bearing portion 57 is formed on an inner surface of the holding hole 55 on the vane 52. The first bearing portion 57 is formed adjacent to the end face 56. The first bearing 57 protrudes inwardly from the inner wall with respect to the holding hole 55. In addition, an annular member which provides a second bearing portion 58 is press fitted into the holding hole 55. The second bearing portion 58 is inserted in the large bore part of the holding hole 55 and fixed. The second bearing portion 58 is located on a position close to the chain sprocket 40, i.e., on a side from which the cam shaft 70 extends. The second bearing portion 57 supports the stopper piston 80 in a slidable manner. As a result, the holding hole 55 provides a large bore part between the first and second bearing portions 57 and 58. The first and second bearing portions 57 and 58 define openings which have identical area.

The stopper piston 80 is a restricting member. The stopper piston 80 is formed in a hollow cylindrical shape having an axial penetrating aperture. The stopper piston 80 generally has a cylindrical portion 83 formed in a hollow cylindrical shape to define an equalizing passage 82 on a center axis thereof. The stopper piston 80 further has a flange portion 84 formed in an annular shape and is integrally formed with the cylindrical portion 83. The flange portion 84 protrudes outwardly from an outer wall surface of the cylindrical portion 83. The cylindrical portion 83 provides two cylindrical parts, a first part 85 and a second part 86 on respective sides of the flange portion 84. In other words, the flange portion 84 divides the cylindrical portion 83 into two parts 85 and 86. The first part 85 is located close to the front plate 20. The second part 86 is located closed to the chain sprocket 40. The first part 85 is a first sliding part supported by a bearing portion. The second part 86 is a second sliding part supported by a bearing portion. The first part 85 is placed in the first bearing portion 57 in a slidable and sealing manner. The first part 85 has an end face directly facing to the front plate 20. The second part 86 is placed in the second bearing portion 58 in a slidable and sealing manner. The second part 86 has an end face directly facing to the chain sprocket 40. The stopper piston 80 is disposed in the holding hole 55 in an axially movable manner. The spring 81 has a first end which abuts on the second bearing portion 58 and a second end which abuts on the flange portion 84 of the stopper piston 80. The spring 81 is disposed to be compressed to generate extending force in an axial direction. Thereby, the spring 81 pushes the stopper piston 80 toward the front plate 20.

The front plate 20 define an engaging hole 21 having a bottom and an opening which opens on a side face facing the vane rotor 50. The engaging hole 21 opens at a position which is substantially middle position between a most retarded position and a most advanced position. The most retarded position and the most advanced position are maximum and minimum positions which the vane 52 can take. The engaging hole 21 opens at a position where the stopper piston 80 is located when the vane rotor 50 is rotated to the middle position. The engaging hole 21 is formed in a shape which can be tightly engaged with a protruded portion of the stopper piston 80 in order to lock relative rotational movement of the housing 11 and the vane rotor 50. The engaging hole 21 is formed in a shape corresponding to a distal end portion of the first part 85 of the stopper piston 80. The engaging hole 21 is a depression formed in a circular shape.

As shown in FIG. 1A, FIG. 16, FIG. 1C, FIG. 3, and FIG. 4, the front plate 20 further defines a groove 22. The groove 22 is formed to extend along a rotational direction of the vane rotor 50. The groove 22 is located on a retard side from the engaging hole 21. In other words, the groove 22 is located on a side close to the shoe 34 with respect to the engaging hole 21. The groove 22 has one end which is communicated with the engaging hole 21. The groove 22 has the other end which is located so as to communicate with the advance chamber 311 when the vane rotor 50 is almost in the most advanced position as shown in FIG. 1B. Therefore, the other end does not communicate with the advance chamber 311 over remaining variable angular range. The groove 22 may also be referred to as the retard side control groove 22. The groove 22 is formed over an angular range located on a middle part of a movable range of the vane 52 between the most retarded position and the most advanced position. The groove 22 extends over an angular range corresponding to a part of path of the first part 85 of the stopper piston 80 within a movable range of the vane 52. The groove 22 extends over an angular range from the engaging hole 21 to a predetermined middle position on the path of the first part 85 toward the most retard position. The groove 22 is formed with a radial width which is capable of receiving the end of the first part 85. Thereby, the end of the first part 85 can directly enters into the engaging hole 21. Also, the end of the first part 85 can enters into the groove 22 when the vane 52 is in the predetermined middle angular range. Therefore, when the vane rotor 50 is rotated in an advancing direction from the most retarded position to the most advanced position, the end of the first part 85 may enter into the groove 22 before reaching to the engaging hole 21. Then, the end of the first part 85 moves in the groove 22 in the advancing direction as the vane rotor 50 rotates. Then, the end of the first part 85 reaches to the engaging hole 21 and enters into the engaging hole 21.

Figure 1A:
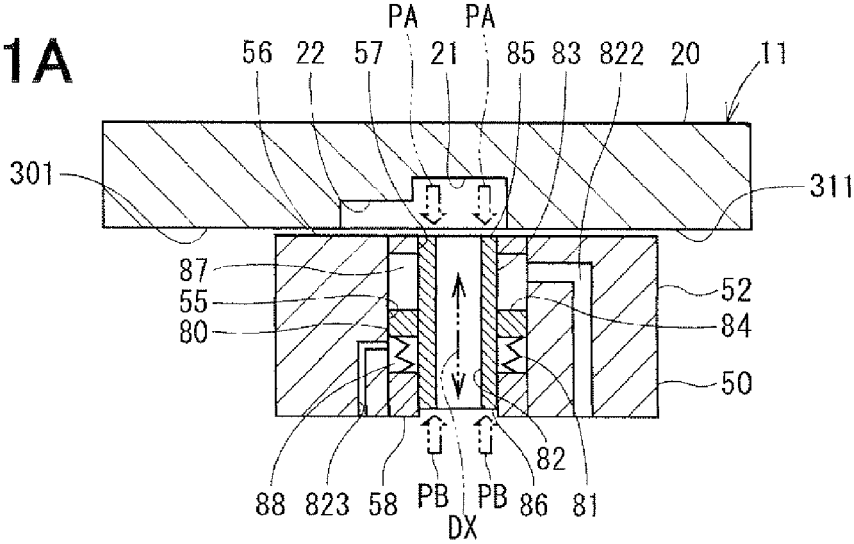
FIG. 1A is a partial enlarged sectional view showing a VVT providing a middle phase according to a first embodiment of the present invention.
Figure 1B:
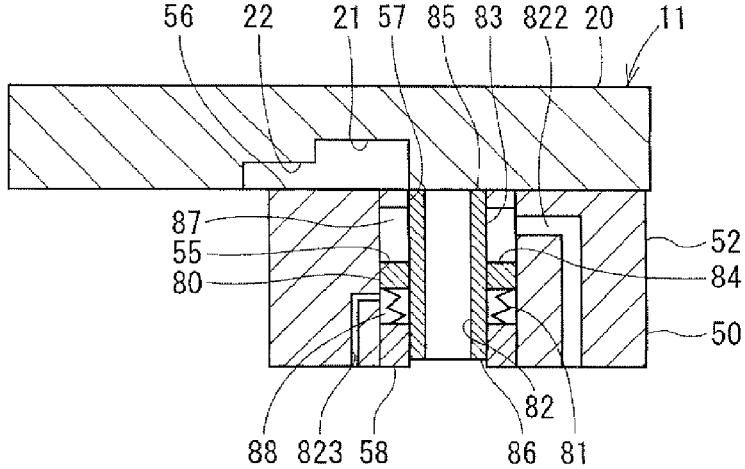
FIG. 1B is a partial enlarged sectional view showing the VVT providing a most advanced phase according to the first embodiment of the present invention.

FIG. 1A shows a cross sectional view on a plane passing through a moving axis DX of the stopper piston 80. The cylindrical portion 83 defines an end face on the first part 85 and an end face on the second part 86 so that both ends have substantially identical surface area. The first part 85 and the second part 86 on the cylindrical portion 83 provide identical effective cross sectional area to receive pressure from the oil. When the end of the first part 85 of the stopper piston 80 is located on the engaging hole 21 or the groove 22, the equalizing passage 82 communicates a chamber defined in the engaging hole 21 and a chamber defined in the holding hole 55 around the second part 86. In other words, the equalizing passage 82 communicated both chambers defined on both ends of the first part 85 and the second part 86.

The first part 85 of the cylindrical portion 83 extends in a predetermined length from the end thereof, and has an outside diameter which is substantially equal to or slightly smaller than an inner diameter of the first bearing portion 57. Therefore, the first part 85 is supported by the first bearing portion 57 which is located on an end close to the engaging hole 21. In other words, the first part 85 is supported on the inner surface of the holding hole 55 which is formed by the vane 52. The second part 86 of the cylindrical portion 83 extends in a predetermined length from the end thereof, and has an outside diameter which is substantially equal to or slightly smaller than an inner diameter of the second bearing portion 58.

In other words, the second bearing portion 58 is formed to have the inner diameter that is substantially equal to or slightly larger than the outer diameter of the second part 86. Therefore, the second part 85 is supported by the second bearing portion 58 which is located on an end close to the chain sprocket 40. In other words, the second part 86 is supported by the second bearing portion 58 in the holding hole 55. The cylindrical portion 83 comes in contact with the first bearing portion 57 and the second bearing portion 58 in a fluid tight manner.

The flange portion 84 is formed to define an outer diameter that is substantially equal to or slightly smaller than an inner diameter of the holding hole 55. The flange portion 84 comes in contact with the inner surface of the vane 52 in a slidable manner and in a fluid tight manner. Thereby, a chamber provided in the holding hole 55 is divided into a first pressure chamber 87 and the second pressure chamber 88. The first pressure chamber 87 is defined between the first bearing portion 57 and the flange portion 84, and the second pressure chamber 88 is defined between the second bearing portion 58 and the flange portion 84. The oil pressure supplied to the first pressure chamber 87 pushes the stopper piston 80 in a direction where the stopper piston 80 is pulled out from the engaging hole 21. On the other side, the spring 81 acts to expand distance between the second bearing portion 58 and the flange portion 84, therefore, a location of the stopper piston 80 in the axial direction thereof can be controlled. That is, the stopper piston 80 enters into and pulled out from the engaging hole 21 in response to balance between force received from the oil pressure in the first pressure chamber 87 and pushing force of the spring 81.

As shown in FIG. 2, passages 71, 72, and 73 are formed on a peripheral wall part of the cam shaft 70. The peripheral wall part is supported by a bearing, not illustrated, on the engine. The passages 71, 72 and 73 are communicated with annular grooves formed on the bearing to provide passages for supplying oil and for returning oil. The cam shaft 70 and the boss portion 51 are formed with a passage 821, a plurality of retard passages 305, and a plurality of advance passages 315. The passage 821 is connected with the passage 71. The retard passages 305 are connected with the passage 72. The advance passages 315 are connected with the passage 73. In FIG. 2, only parts of the passages 71, 72, 73, 305, and 315 illustrated.

As shown in FIG. 2, a passage 822 is formed in the boss portion 51 of the vane rotor 50. The passage 822 is connected to both the first pressure chamber 87 formed in the vane 52 and the passage 821. Thereby, the passage 71 and the first pressure chamber 87 are communicated with each other via the passages 821 and 822. The passage 822 may be also referred to as a supply passage or a control passage which can supply the oil to the first pressure chamber 87. The boss portion 51 is further formed with three retard passages 306. The retard passages 306 communicate between the retard passages 305 and the retard chambers, respectively. Thereby, the passage 72 and the retard chambers are communicated via the retard passages 305 and 306. Further, the boss portion 51 is formed with three advance passages 316. The advance passages 316 communicate between the advance passages 315 and the advance chambers, respectively. Thereby, the passage 73 and the advance chambers are communicated via the advance passages 315 and 316.

The first pressure chamber 87 is connected to an oil pump and an oil tank, not illustrated, via the passages 822 and 821 and the passage 71. The oil pump is a lubricating oil pump which sucks up the oil from the oil tank and supplies the oil to the first pressure chamber 87 through an appropriate control valve, not illustrated. If the oil is supplied to the first pressure chamber 87, the internal pressure of the first pressure chamber 87 is increased, and the stopper piston 80 is pushed in a direction pulling out the stopper piston 80 from the engaging hole 21. If the stopper piston 80 is pulled out from the engaging hole 21, an engagement between the vane rotor 50 and the front plate 20 is unlocked and the vane rotor 50 is permitted to rotate relative to the housing 11.

If the oil in the first pressure chamber 87 is discharged through a control valve to the oil tank, the internal pressure of the first pressure chamber 87 is decreased. As a result, the stopper piston 80 moves toward the front plate 20 by pushing force of the spring 81. A part of the first part 85 may protrude from the first bearing portion 57. If the first part 85 is located above the engaging hole 21, the first part 85 enters into the engaging hole 21.

The vane rotor 50 is formed with a passage 823 which is communicated with the second pressure chamber 88. The passage 823 may be also referred to as a drain passage. The second pressure chamber 88 is connected to the oil tank via the passage 823. Therefore, as the stopper piston 80 pulled out from the engaging hole 21, the air or the oil leaked to the second pressure chamber 88 is returned to the oil tank.

The retard chambers 301, 302, and 303 are connected to the oil pump and the oil tank via the retard passages 306 and 305 and the passage 72. The advance chambers 311, 312, and 313 are connected to the oil pump and the oil tank via the advance passages 316 and 315 and the passage 73. The oil pump sucks up the oil from the oil tank and supplies the oil to the retard chambers 301, 302, and 303 or the advance chambers 311, 312, and 313 through an appropriate control valve.

The retard chambers 301, 302, and 303 and the advance chambers 311, 312, and 313 are connected to the oil tank through the control valve. By switching the control valve, it is possible to switch in two modes. In a first mode, the oil is supplied to one of the retard chambers and the advance chambers, and the oil is discharged from the other one of the retard chambers and the advance chambers to an oil tank. In a second mode, the oil is supplied to the other one of the retard chambers and the advance chambers, and the oil is discharged from the one of the retard chambers and the advance chambers to an oil tank. Thereby, the relative rotating position of the vane rotor 50 to the housing 11 is changed in response to a balance of the oil pressure in the chambers, and a phase angle between the crankshaft and the cam shaft 70 is changed.

Next, an example of an operation from a usual engine starting to an engine stopping is explained. The pressure of the oil from an oil pump, not illustrated, is not yet positively supplied to the retard chambers, the advance chambers, and the first pressure chamber 87 at the time of the engine starting as shown in FIG. 2. For this reason, the vane rotor 50 is located with respect to the shoe housing 30 in a position that is substantially middle position between the most retard position and the most advance position. That is, the vane rotor 50 is in the location shown in FIG. 1A with respect to the front plate 20.

In this condition, the stopper piston 80 is engaged with the engaging hole 21, therefore, the vane rotor 50 is mechanically locked with the front plate 20. That is, a relative rotation of the vane rotor 50 with respect to the housing 11 is restricted. Therefore, the vane rotor 50 rotates together with the front plate 20, the housing 11. The rotational driving force is stably transmitted to the cam shaft 70 from the crankshaft by connecting the vane rotor 50 with the front plate 20. In addition, even if the cam shaft 70 generates a fluctuation torque in positive and negative directions, the vane rotor 50 and the housing 11 do not generate rotational vibrations. Therefore, it is possible to prevent hitting noise between the vane rotor 50 and the housing 11.

During running the engine normally, the oil may be supplied to the first pressure chamber 87 from the oil pump by switching the control valve. As shown in FIG. 1A, if the oil is supplied to the first pressure chamber 87 and the internal pressure is increased, the stopper piston 80 is pulled out from the engaging hole 21. As the stopper piston 80 is disengaged with the engaging hole 21, a mechanical engagement between the vane rotor 50 and the housing 11 is released. Then, the vane rotor 50 becomes free to perform relative rotation within a variable angular range between the most retarded position and the most advanced position with respect to the housing 11.

In this condition, if the oil is supplied to the advance chambers 311, 312, and 313 from the oil pump, the oil with increased pressure in the advance chambers 311, 312, and 313 push the vanes 52, 53, and 54 in an advancing direction. Thereby, the vane rotor 50 rotates in the advancing direction. Then, the vane rotor 50 reaches to the most advanced position as shown in FIG. 3.

On the other hand, if the oil is supplied to the retard chambers 301, 302, and 303 from the oil pump, the oil with increased pressure in the retard chambers 301, 302, and 303 push the vanes 52, 53, and 54 in a retarding direction. Thereby, the vane rotor 50 rotates in the retarding direction. Then, the vane rotor 50 reaches to the most retarded position as shown in FIG. 4.

Thus, it is possible to control the relative rotation of the vane rotor 50 with respect to the housing 11 by the oil supplied to the retard chambers and the advance chambers. As a result, a phase angle between the crankshaft and the cam shaft 70 is changed and adjusted to a target phase angle.

If the user operates to stop the engine when the stopper piston 80 is located on an advanced side from the position where the engaging hole 21 is formed as shown in FIG. 1B and FIG. 3, the oil is discharged from the first pressure chamber 87. Thereby, the internal pressure of the first pressure chamber 87 is decreased. The stopper piston 80 is pushed by force of the spring 81 toward the front plate 20. Then, as the vane rotor 50 fluctuates in the advancing direction and the retarding direction, the stopper piston 80 enters into and engages with the engaging hole 21.

Figure 1C:
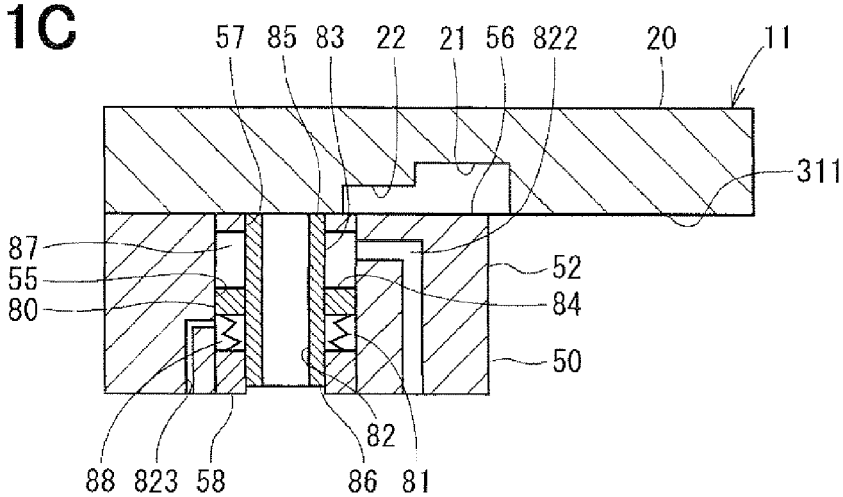
FIG. 1C is a partial enlarged sectional view showing the VVT providing a most retarded phase according to the first embodiment of the present invention.

If the user operates to stop the engine when the stopper piston 80 is located on a retarded side from the position where the engaging hole 21 is formed as shown in FIG. 1C and FIG. 4, the oil is discharged from the first pressure chamber 87. Then, as the vane rotor 50 fluctuates in the advancing direction and the retarding direction, the stopper piston 80 enters into and engages with the engaging hole 21. Usually, the engine is prepared for next restart by stopping the engine in a condition in which the stopper piston 80 is engaged with the engaging hole 21, i.e., in which the relative rotation of the vane rotor 50 to the housing 11 is restricted.

In addition, in this embodiment, during a period from a regular operation to a stopping of operation, the oil is discharged from the first pressure chamber 87 to the oil tank, and the stopper piston 80 is engaged with the groove 22 by switching the control valve. Thereby, a movement of the stopper piston 80 in the retarding direction is restricted by an inner wall surface defining the groove 22. By performing an advancing control further in this condition, the stopper piston 80 rotates in the advancing direction along the groove 22, then, the first part 85 enters into the engaging hole 21 smoothly.

Next, an operation of this embodiment when restarting the engine after the engine is stalled in an unexpected manner. The engine may be stopped by an unexpected stall while the stopper piston 80 is not engaged with the engaging hole 21. In this case, at the time of restarting the engine in the next drive, if the oil is still in the first pressure chamber 87, the oil is discharged. As a result, the stopper piston 80 moves toward the front plate 20 by pushing force of the spring 81. The cam shaft 70 generates a fluctuating torque at this time. Thereby, the vane rotor 50 fluctuates in the advancing direction and the retarding direction. Then, the stopper piston 80 pushed toward the front plate 20 enters into and engages with the engaging hole 21. As a result, the vane rotor 50 is connected with the front plate 20, and the relative rotation between the vane rotor 50 and the housing 11 is restricted.

In the first embodiment, the equalizing passage 82 is located in the stopper piston 80. Therefore, when the first part 85 enters into the engaging hole 21 or the groove 22, the oil in the engaging hole 21 and the groove 22 is discharged to a chamber formed on the end face of the second part 86 in the holding hole 55 via the equalizing passage 82. It is not necessary to push back the oil against the oil pressure in the engaging hole 21 or the groove 22 by the first part 85. The stopper piston 80 can easily enter into the engaging hole 21. As a result, it is possible to improve the response of the stopper piston 80. It is also possible to restrict the relative rotation between the vane rotor 50 and the housing 11 easily and with high accuracy. Therefore, it is possible to improve the response of the variable valve timing apparatus 10, and to control phase angle of the cam shaft 70 with high accuracy.

Advantages of the first embodiment can be explained by comparing the following comparative example. In order to address a problem of influence on a response speed caused by a stopper piston which receives flow resistance of the oil in the engaging hole, for example, it is possible to employ a comparative example in which a relief passage communicated with the engaging hole is formed to discharge the oil. If there is such a passage, when the stopper piston enters the engaging hole, the oil filled in the engaging hole is discharged to the outside via the passage, therefore, the oil does not impede the stopper piston.

However, in this comparative example, in order to control leakage of the oil through the relief passage, it is necessary to shut down a communication path between the chamber and the relief passage in a regular operating stage. For example, in order to cover and seal the engaging hole by an end face of a vane over an whole range from the most advanced position to the most retarded position, a circumferential width of the vane must be widened greatly.

In the case of the comparative example, the vane occupies the most part of a circumferential chamber defined in a housing. A circumferential side surface of the vane and a circumferential side surface of the housing are closely located. Therefore, a movable range of the vane must be relatively narrowed. That is, if a response of the stopper piston is improved by employing the comparative example, it is unavoidable to make the variable angular range of the vane rotor narrow.

Contrary, according to the embodiment, there is no relief passage for discharging the oil from the engaging hole 21 to the outside of the VVT 1. The stopper piston 80 is provided with the equalizing passage 82 which communicates the engaging hole 21 and a chamber formed in the holding hole 55 at a region close to the chain sprocket 40. Therefore, there is no disadvantage, even if the engaging hole 21 and the groove 22 communicate with the retard chamber 301 or the advance chamber 311. It is possible to improve response of the stopper piston without increasing a leakage amount of the oil. Thus, it is not necessary to close the engaging hole 21 and the groove 22 by the end face 56 of the vane 52, therefore, it is possible to improve the degree of design freedom for the vane 52, and to make a circumferential width of the vane narrow. Therefore, according to the embodiment, it is possible to make the variable angular range of the vane rotor 50 to the housing wide, and to improve an operation response of the stopper piston 80.

The first part 85 and the second part 86 of the stopper piston 80 receive pulsations of the oil pressure which is produced in the VVT by rotating movement of the vane rotor 50. In FIG. 1A, magnitude of the pulsations and acting directions are indicated by arrow symbols. Arrow symbol PA indicates pulsations acting on the end face of the first part 85. Arrow symbol PB indicates pulsations acting on the end face of the second part 86. As shown in FIG. 1A, FIG. 1B, and FIG. 1C, the engaging hole 21 and the groove 22 are filled with the oil supplied from the retard chamber 301 and the advance chamber 311. The holding hole 55 is also filled with the oil supplied from the equalizing passage 82. Therefore, as shown in FIG. 1A, the stopper piston 80 receives the oil pressure in both directions indicated by PA and PB.

The first part 85 and the second part 86 of the stopper piston 80 provide effective cross sectional areas which have substantially identical area. Therefore, even if pulsations are produced in the oil pressure, the stopper piston 80 receives almost the same force from the pulsations acting in the direction PA and the pulsations acting in the direction PB.

Return to the comparative example, the oil is not tightly sealed in the engaging hole, therefore, there is no pulsations acting on the stopper piston in directions, such as indicated by the symbol PA and PB in FIG. 1A.

In another aspect, in a conventional configuration relating to the stopper piston, there are many cases in which an oil passage communicated with an engaging hole is formed. In this case, the oil in the engaging hole may be discharged to a space which is different from a chamber in which the stopper piston is housed. In the conventional configurations, there may be a case in which magnitude of pulsations acting on one end facing the engaging hole and on the other end are different, or a case in which no pulsations act on the other end.

Therefore, in the comparative example or the conventional configurations, the stopper piston may be adversely moved by the pulsations. It is concerned that the stopper piston is engaged or disengaged with the engaging hole at an unexpected timing.

Contrary, as shown in FIG. 1A, regarding the stopper piston 80 in the first embodiment, with respect to a reciprocating direction indicated by an arrow symbol DX, the pulsations equally act on the first part 85 and the second part 86 and are cancelled each other. That is, the chambers arranged on both ends of the stopper piston 80 are communicated via the equalizing passage 82, and the both ends are formed in substantially identical area. Therefore, the stopper piston 80 can cancel the pulsations acting in the direction PB by balancing it with the pulsation acting in the direction PA. Therefore, the location of the stopper piston 80 in the reciprocating direction DX is not fluctuated even if the oil pressure contains pulsations. Thus, in this embodiment, it is possible to prevent unexpected movement of the stopper piston 80 by stabilizing the location of the stopper piston 80.

As explained above, the first embodiment can provide both advantages that a variable angular range is enlarged and a response speed of the stopper piston is increased. In addition, it is possible to prevent unexpected movement of the stopper piston, therefore, it is possible to stabilize the operation of the VVT and to control the phase angle of the cam shaft with high accuracy.

Second Embodiment

Figure 5:
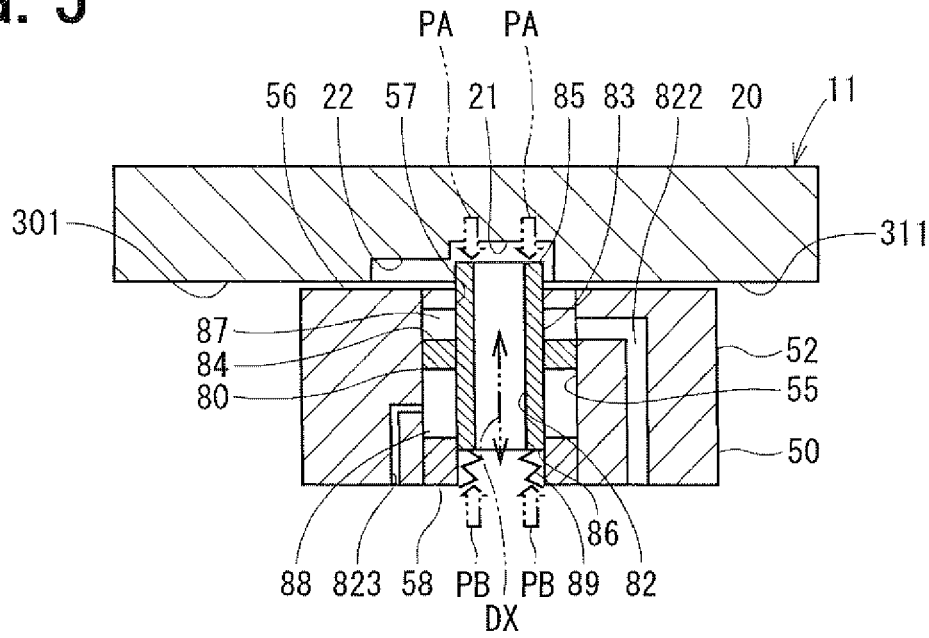
FIG. 5 is a partial enlarged sectional view showing a VVT providing a middle phase according to a second embodiment of the present invention.

FIG. 5 shows a second embodiment of the present invention. FIG. 5 shows a view corresponding to FIG. 1A.

In the first embodiment, the elastic member is disposed in the second pressure chamber 88. However, as shown in FIG. 5, in this embodiment, a spring 89 is located in a chamber defined by an end face of the second part 86 of the stopper piston 80 in the holding hole 55. The spring 89 is still disposed in the holding hole 55. One end of the spring 89 comes in contact with the end face of the second part 86 of the stopper piston 80. The other end of the spring 89 is attached and fixed on the second bearing portion 58, for example. As shown in the second embodiment, the elastic member may be disposed on alternative locations.

Third Embodiment

Figure 6:
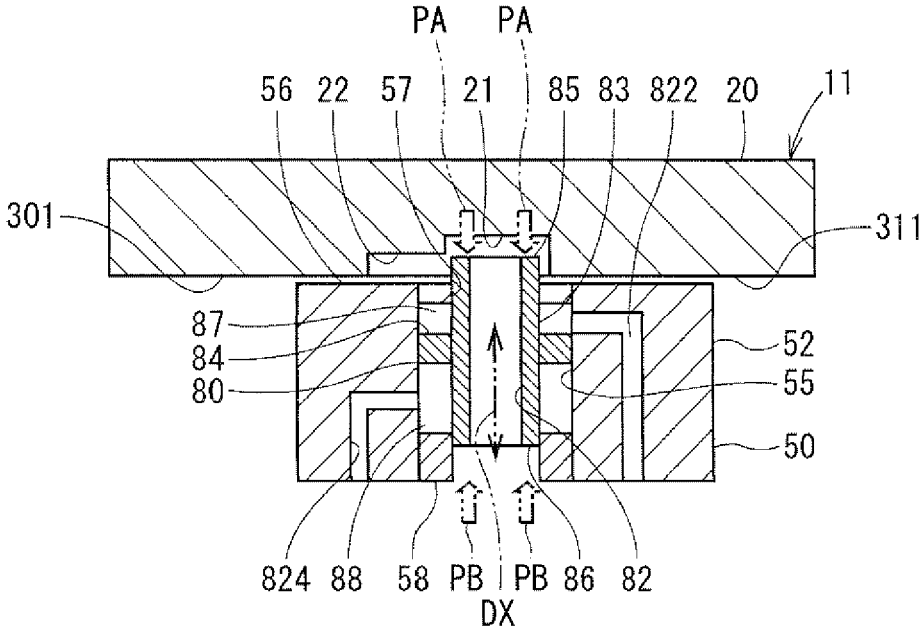
FIG. 6 is a partial enlarged sectional view showing a VVT providing a middle phase according to a third embodiment of the present invention.

In the above mentioned embodiments, the stopper piston 80 moves in response to balance of the oil pressure in the first chamber 87 and force of the spring 81. Alternatively, the stopper piston 80 may be moved by balance of only the oil pressure in the first and second chambers 87 and 88. FIG. 6 shows a second embodiment of the present invention. FIG. 6 shows a view corresponding to FIG. 1A.

Different points from the first embodiment are that there is no elastic member such as the spring 81, and that a supply passage 824 is formed to be connected to the second pressure chamber 88. The supply passage 824 may also be referred to as a control passage 824. The control passage 824 is connected to the oil pump and the oil tank via a passage formed through the vane rotor 50 and the cam shaft 70. In this configuration, if a user operates to stop the engine, the oil pump supplies the oil to the second pressure chamber 88 through the control valve. In addition, the oil in the first pressure chamber 87 is discharged through the control valve. Thereby, the internal pressure of the first pressure chamber 87 is decreased. Simultaneously, the internal pressure of the second pressure chamber 88 is increased. Then, the stopper piston 80 moves toward the front plate 20 in response to balance of force acting on the flange portion 84 from the first pressure chamber 87 and the second pressure chamber 88.

In this embodiment, the first pressure chamber 87 and the second pressure chamber 88 are independently defined as well as the first and second embodiment. Therefore, it is possible to control the stopper piston 80 by controlling oil flow from and to the chambers. In addition, the stopper piston 80 equally receives pulsation of the oil pressure on both ends thereof. Therefore, in the third embodiment, it is possible to achieve the above mentioned advantages without using an elastic member.

Other Embodiment

In the above embodiments, the VVTs are installed in the drive train for the intake valve. However, the VVTs may be installed in a drive train for an exhaust valve. The restricting member may be held on components forming the housing and the engaging hole may be formed on the vane rotor. The VVT may further include additional bearing portions and additional flange portions. The VVT may be provided with at least one elastic member disposed in at least one pressure chamber defined next to the flange portion.

Although the present invention has been fully described in connection with the preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A variable valve timing apparatus installed in a drive train for transmitting driving force from a drive shaft to a driven shaft which actuates at least one of an intake valve and an exhaust valve to adjust valve timing, the apparatus comprising:

a housing having a peripheral wall, and side walls placed on both axial ends of the peripheral wall to define an accommodation chamber, the housing being rotatable with one of the drive shaft and the driven shaft;

a vane rotor disposed in the accommodation chamber, the vane rotor being rotatable with the other one of the drive shaft and the driven shaft within a predetermined angular range in response to a pressure of fluid supplied to a pressure chamber defined within the accommodation chamber; and a restricting member for restricting relative rotation of the vane rotor with respect to the housing, a first chamber being defined between the restricting member and an inner wall of a holding hole, wherein one of the vane rotor and the housing define the holding hole which holds the restricting member in a manner that the restricting member is movable, wherein the other one of the vane rotor and the housing define an engaging hole which is able to be engaged with an end of the restricting member, wherein, when the engaging hole is located on an axis direction of the restricting member, the restricting member is moved into the engaging hole when the pressure of the fluid in the first chamber is lowered, and the restricting member is moved out of the engaging hole when a pressure of the fluid in the first chamber is raised, wherein the restricting member is formed in a hollow cylindrical shape which defines an equalizing passage capable of communicating the engaging hole and the holding hole to flow the fluid when the restricting member enters into the engaging hole, and wherein, when the engaging hole is located on the axis direction of the restricting member, the equalizing passage of the restricting member enables fluid to always flow between the engaging hole and the holding hole, irrespective of a position of the restricting member in the axis direction of the restricting member.

2. The variable valve timing apparatus in claim 1, wherein the vane rotor includes:

a vane support portion disposed in the accommodation chamber, the vane support portion being rotatable with the other one of the drive shaft and the driven shaft; and a vane member disposed in the accommodation chamber and disposed on the vane support portion, the vane member being driven in a rotating manner within a predetermined angular range in response to a pressure of fluid supplied in a pressure chamber in the accommodation chamber, and wherein the restricting member defines both ends having substantially identical area, and wherein the holding hole is defined on the vane member, and wherein the engaging hole is defined on the housing, and wherein the equalizing passage is formed to flow the fluid in the engaging hole to the holding hole when the restricting member projects from the holding hole and engages to the engaging hole.

3. The variable valve timing apparatus in claim 2, wherein the vane member includes a bearing portion disposed on an inner wall of the vane member which define the holding hole, the bearing portion being protruded inwardly to support the restricting member in a sliding manner, and wherein the restricting member has an outer wall on which a flange portion is formed, the flange portion being protruded outwardly to come in contact in a sliding manner with the inner wall of the vane member which define the holding hole.

4. The variable valve timing apparatus in claim 3, wherein the bearing portion includes:

a first bearing portion disposed on a position close to the engaging hole; and a second bearing portion fixed in the holding hole to support the restricting member at an opposite part to a part which is supported by the first bearing portion, and wherein the holding hole defines:

a first pressure chamber defined between the first bearing portion and the flange portion, and a second pressure chamber defined between the second bearing portion and the flange portion, and wherein the vane member defines a supply passage through which the fluid can flow, the supply passage being communicated to at least one of the first pressure chamber and the second pressure chamber.

5. The variable valve timing apparatus in claim 4, further comprising:

a positioning member disposed between the bearing portion and the flange portion, which is capable of controlling position of the restricting member in a movable direction thereof.

6. A variable valve timing apparatus installed in a drive train for transmitting driving force from a drive shaft to a driven shaft which actuates at least one of an intake valve and an exhaust valve to adjust valve timing, the apparatus comprising:

a housing having a peripheral wall, and side walls placed on both axial ends of the peripheral wall to define an accommodation chamber, the housing being rotatable with one of the drive shaft and the driven shaft;

a vane rotor disposed in the accommodation chamber, the vane rotor being rotatable with the other one of the drive shaft and the driven shaft within a predetermined angular range in response to a pressure of fluid supplied in a pressure chamber in the accommodation chamber; and a restricting member for restricting relative rotation of the vane rotor with respect to the housing, wherein one of the vane rotor and the housing define a holding hole which holds the restricting member in a manner that the restricting member is movable, the other one of the vane rotor and the housing define an engaging hole which is able to be engaged with an end of the restricting member, and the restricting member being formed in a hollow cylindrical shape which defines an equalizing passage capable of communicating the engaging hole and the holding hole to flow the fluid when the restricting member enters into the engaging hole, the vane rotor includes:

a vane support portion disposed in the accommodation chamber, the vane support portion being rotatable with the other one of the drive shaft and the driven shaft; and a vane member disposed in the accommodation chamber and disposed on the vane support portion, the vane member being driven in a rotating manner within a predetermined angular range in response to a pressure of fluid supplied in a pressure chamber in the accommodation chamber, and wherein the restricting member defines both ends having substantially identical area, the holding hole is defined on the vane member, the engaging hole is defined on the housing, the equalizing passage is formed to flow the fluid in the engaging hole to the holding hole when the restricting member projects from the holding hole and engages to the engaging hole, the vane member includes a bearing portion disposed on an inner wall of the vane member which define the holding hole, the bearing portion being protruded inwardly to support the restricting member in a sliding manner, and the restricting member has an outer wall on which a flange portion is formed, the flange portion being protruded outwardly to come in contact in a sliding manner with the inner wall of the vane member which define the holding hole.

7. The variable valve timing apparatus in claim 6, wherein the bearing portion includes:

a first bearing portion disposed on a position close to the engaging hole; and a second bearing portion fixed in the holding hole to support the restricting member at an opposite part to a part which is supported by the first bearing portion, wherein the holding hole defines:

a first pressure chamber defined between the first bearing portion and the flange portion, and a second pressure chamber defined between the second bearing portion and the flange portion, and wherein the vane member defines a supply passage through which the fluid can flow, the supply passage being communicated to at least one of the first pressure chamber and the second pressure chamber.

8. The variable valve timing apparatus in claim 6, further comprising:

a positioning member disposed between the bearing portion and the flange portion, which is capable of controlling position of the restricting member in a movable direction thereof.

* * * * *